US010372062B2

(12) United States Patent
Maeshima et al.

(10) Patent No.: US 10,372,062 B2
(45) Date of Patent: Aug. 6, 2019

(54) DEVELOPING APPARATUS AND PROCESS CARTRIDGE

(71) Applicant: CANON KABUSHIKI KAISHA, Tokyo (JP)

(72) Inventors: Hideki Maeshima, Mishima (JP); Shuichi Gofuku, Numazu (JP); Soichi Ishii, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/141,559

(22) Filed: Sep. 25, 2018

(65) Prior Publication Data

US 2019/0101849 A1 Apr. 4, 2019

(30) Foreign Application Priority Data

Sep. 29, 2017 (JP) ..... 2017-191932

(51) Int. Cl.
*G03G 15/08* (2006.01)
*G03G 21/18* (2006.01)

(52) U.S. Cl.
CPC ..... *G03G 15/0887* (2013.01); *G03G 21/1814* (2013.01)

(58) Field of Classification Search
CPC ..... G03G 15/0887; G03G 21/1814
See application file for complete search history.

(56) References Cited

U.S. PATENT DOCUMENTS 5,568,237 A * 10/1996 Ishida ..... G03G 15/0868 222/DIG. 1
2007/0196135 A1* 8/2007 Fukuta ..... G03G 15/0874 399/254
2013/0259530 A1* 10/2013 Kato ..... G03G 15/0889 399/254
2014/0056621 A1* 2/2014 Hashimoto ..... G03G 15/0867 399/254
2016/0252848 A1* 9/2016 Abe ..... G03G 15/0891 399/254

FOREIGN PATENT DOCUMENTS

JP 2006-276615 A 10/2006
JP 2011-99894 A 5/2011
JP 2011-253203 A 12/2011
JP 2013-250298 A 12/2013
JP 2014-044326 A 3/2014
JP 2016-161714 A 9/2016
JP 2018-017972 A 2/2018

* cited by examiner

*Primary Examiner* — G. M. A Hyder
(74) *Attorney, Agent, or Firm* — Canon U.S.A., Inc. IP Division

(57) ABSTRACT

A second conveying member is disposed upstream of a first conveying member in a rotation direction of a conveyance shaft in a state in which a fixed end of the second conveying member and a fixed end of the first conveying member overlap each other. In a first position, a second position, and a third position that sequentially distance away from a drive transmission member in an axial direction of the conveyance shaft, a free end of the first conveying member and a free end of the second conveying member sequentially becomes larger as well.

18 Claims, 12 Drawing Sheets

FIG. 7

| | | DRIVE SIDE | NON-DRIVE SIDE |
|---|---|---|---|
| A | TONER BEARING AMOUNT | SMALL < LARGE | |
| B | TONER CONVEYING CAPACITY | MODERATE = MODERATE | |
| A + B | TONER CONVEYANCE AMOUNT TO DEVELOPING CHAMBER | SMALL < LARGE | |

FIG. 9

| | | DRIVE SIDE | NON-DRIVE SIDE |
|---|---|---|---|
| A | TONER BEARING AMOUNT | SMALL < LARGE | |
| B | TONER CONVEYING CAPACITY | LARGE > SMALL | |
| A + B | TONER CONVEYANCE AMOUNT TO DEVELOPING CHAMBER | MODERATE = MODERATE | |

DEVELOPING APPARATUS AND PROCESS CARTRIDGE

BACKGROUND OF THE INVENTION

Field of the Invention

The present disclosure relates to a developing apparatus and a process cartridge. Particularly, the present disclosure relates to a developing apparatus or a process cartridge that is detachably attachable to an electrophotographic image forming apparatus.

Description of the Related Art

In electrophotographic image forming apparatuses, it is typical to integrate members having various functions into one unit or into a cartridge to facilitate maintenance. Particularly, in developing units that implement a developing function, there is a configuration including functional members such as a developer carrying member that carries developer and a conveying member that conveys the developer to the developer carrying members.

For example, Japanese Patent Laid-Open No. 2011-253203 (Patent Literature 1) proposes a developing unit that includes a conveying member that agitates and conveys developer inside an accommodating chamber. Specifically, a flexible sheet member is attached to a rotating shaft of a conveying member that agitates and conveys the developer with the rotation movement. Furthermore, the developer accommodated in the developer accommodating chamber is conveyed to the developing chamber with restoring force generated by elastic deformation of the flexible sheet member.

Furthermore, Japanese Patent Laid-Open No. 2011-99894 (Patent Literature 2) proposes a method that varies, in a longitudinal direction, lengths of a sheet member in a direction orthogonal to the longitudinal direction to reduce that load of the rotation movement of the conveying member.

Moreover, Japanese Patent Laid-Open No. 2016-161714 (Patent Literature 3) and Japanese Patent Laid-Open No. 2013-250298 (Patent Literature 4) propose configurations in which a plurality of sheet members are overlapped so as to increase a toner conveying capacity of the sheet member (Patent Literature 3) and in which a metal member (a flat spring) is disposed on a backside of the sheet member (Patent Literature 4).

In either of the configurations in Patent Literatures 1 to 4, the toner is conveyed with a flexible sheet member that is attached to a toner conveyance shaft, and the toner conveyance shaft is rotationally driven by receiving driving force from a main body through a drive transmission portion attached to one end (one side) of the toner conveyance shaft in the longitudinal direction.

However, in conventional configurations described above, since only one side of the toner conveyance shaft is rotationally driven, a phenomenon such as the toner conveyance shaft becoming twisted and deformed along the axial direction may occur due to a load (resistance) of the toner inside the developer accommodating chamber. Particularly, such a phenomenon is more noticeably seen in cases in which the toner conveyance shaft is formed of an elastic material. Affected by the toner conveyance shaft twisting and deforming phenomenon, a flexion amount of the sheet member may tend to be non-uniform in the longitudinal direction, and the toner amount held by the sheet member in the longitudinal direction may become non-uniform. With the above, there may be cases in which there is more toner on a non-drive side than on a drive side (on which a drive transmission portion exists), and the toner conveyance amount to the developing chamber may become non-uniform in the longitudinal direction. As a result, an image defect such as a density of the image on the printed matter being non-uniform in the longitudinal direction may tend to occur.

SUMMARY OF THE INVENTION

The present disclosure has been made in view of the circumstances described above and provides a developing apparatus and a process cartridge that can further make an amount of toner conveyed from a developer accommodating chamber to a developing chamber uniform in a longitudinal direction.

A developing apparatus of the present disclosure includes a developing portion that accommodates a developer carrying member that carries developer; a developer accommodating portion disposed below the developing portion, the developer accommodating portion accommodating the developer, a conveyance shaft provided in the developer accommodating portion, the conveyance shaft being capable of conveying the developer accommodated in the developer accommodating portion and being rotatable in a predetermined rotation direction, a drive transmission member which is provided on the developer accommodating portion and which is connected to one end of the conveyance shaft in an axial direction of the conveyance shaft, the drive transmission member rotating the conveyance shaft by receiving driving force from outside, a first conveying member, having a first end thereof being a fixed end attached to the conveyance shaft and a second end thereof being a free end, and a second conveying member, having a first end thereof being a fixed end attached to the conveyance shaft, and a second end thereof being a free end, and a length between the fixed end and the free end of the second conveying member being shorter than that of the first conveying member. The second conveying member is disposed upstream of the first conveying member in the rotation direction of the conveyance shaft in a state in which the fixed end of the second conveying member and the fixed end of the first conveying member overlap each other. In a first position, a second position, and a third position that sequentially distance away from a drive transmission member in an axial direction of the conveyance shaft, the free end of the first conveying member and the free end of the second conveying member sequentially becomes larger as well.

Furthermore, another developing apparatus of the present disclosure includes a developing portion that accommodates a developer carrying member that carries developer; a developer accommodating portion disposed below the developing portion, the developer accommodating portion accommodating the developer, a conveyance shaft provided in the developer accommodating portion, the conveyance shaft being capable of conveying the developer accommodated in the developer accommodating portion and being rotatable in a predetermined rotation direction, a drive transmission member which is provided on the developer accommodating portion and which is connected to one end of the conveyance shaft in an axial direction of the conveyance shaft, the driving transmission member rotating the conveyance shaft by receiving driving force from outside, a first conveying member, having a first end thereof being a fixed end attached to the conveyance shaft and a second end thereof being a free end, and a second conveying member, having a first end thereof being a fixed end attached to the conveyance shaft, a second end thereof being a free end, and a length between the fixed end and the free end of the second conveyance member being shorter than that of the first conveying member. The second conveying member is disposed upstream of the first conveying member in a rotation direction of the conveyance shaft in a state in which the fixed end of the second conveying member and the fixed end of the first conveying member overlap each other, and in a position closest to the drive transmission member and a position farthest away from the drive transmission member in the axial direction of the conveyance shaft, a distance between the free end of the first conveying member and the free end of the second conveying member is larger at the position farthest away than at the position closest.

Furthermore, a process cartridge of the present disclosure is a process cartridge detachably attachable to a main body of an image forming apparatus that forms an image, the process cartridge including a developing apparatus, an image carrying member that carries an electrostatic latent image, in which the electrostatic latent image carried on the image carrying member is developed with the developing apparatus.

Further features of the present disclosure will become apparent from the following description of exemplary embodiments with reference to the attached drawings.

BRIEF DESCRIPTION OF THE DRAWINGS

FIG. 7 is a diagram illustrating relationships between toner conveyance amounts and positions in the longitudinal direction according to the comparative example of the first exemplary embodiment of the present disclosure.

FIG. 9 is a diagram illustrating relationships between toner conveyance amounts and positions in the longitudinal direction according to the first exemplary embodiment of the present disclosure.

DESCRIPTION OF THE EMBODIMENTS

The present disclosure can also be implemented in the form of either a developing apparatus or a process cartridge.

Hereinafter, an electrophotographic image forming apparatus in which a process cartridge according to the present disclosure is used will be described with reference to the drawings. Note that the exemplary embodiments described hereinafter illustrate the present disclosure in an exemplified manner, and the dimensions, the materials, the shapes, and the relative positional relationships described hereinafter do not limit the scope of the present disclosure unless particularly described in a specific manner.

Herein, an electrophotographic image forming apparatus is an image forming apparatus that forms an image on a recording medium through an electrophotographic image forming process. Furthermore, examples of the electrophotographic image forming apparatus include an electrophotographic copying machine, an electrophotographic printer (for example, a laser printer, an LED printer, and the like), a facsimile machine, and a word processor.

Furthermore, a process cartridge is a charging member, a developing member, and a cleaning member, and an electrophotographic photosensitive drum formed into a cartridge in an integrated manner, in which the cartridge is detachably attachable to a main body of the electrophotographic image fainting apparatus. Furthermore, a process cartridge is at least one of a charging member, a developing member, or a cleaning member being integrally formed into a cartridge together with an electrophotographic photosensitive drum, in which the cartridge is detachably attachable to a main body of the electrophotographic image forming apparatus. Furthermore, a cartridge is at least a developing member and an electrophotographic photosensitive drum integrally formed into a cartridge in which the cartridge is detachably attachable to a main body of the electrophotographic image forming apparatus.

Furthermore, the developing apparatus is a developing member that develops a latent image on an electrophotographic photosensitive drum, a developing frame that supports the developing member, and components related to the developing member integrally formed so as to be detachable attachable to a main body of an image forming apparatus.

Furthermore, a developer container is a unit that contains developer used in an electrophotographic image forming process, and includes a developer case that contains the developer and an agitating member that sends out the contained developer.

First Exemplary Embodiment

Electrophotographic Image Forming Apparatus

Figure 2:
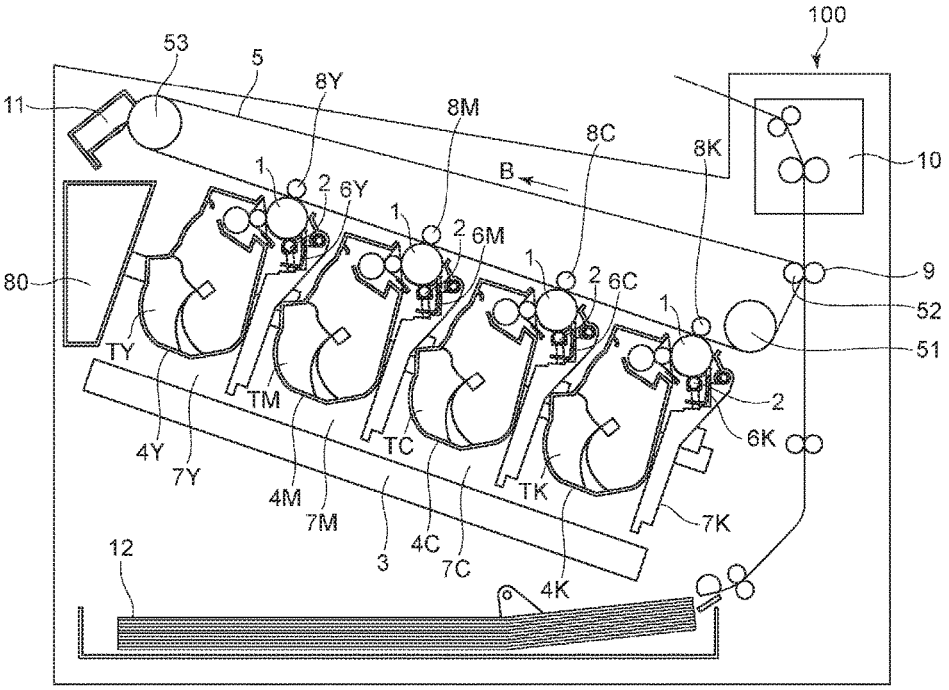
FIG. 2 is a cross-sectional conceptual diagram of an electrophotographic image forming apparatus in which the process cartridge according to the first exemplary embodiment of the present disclosure is used.
Figure 3:
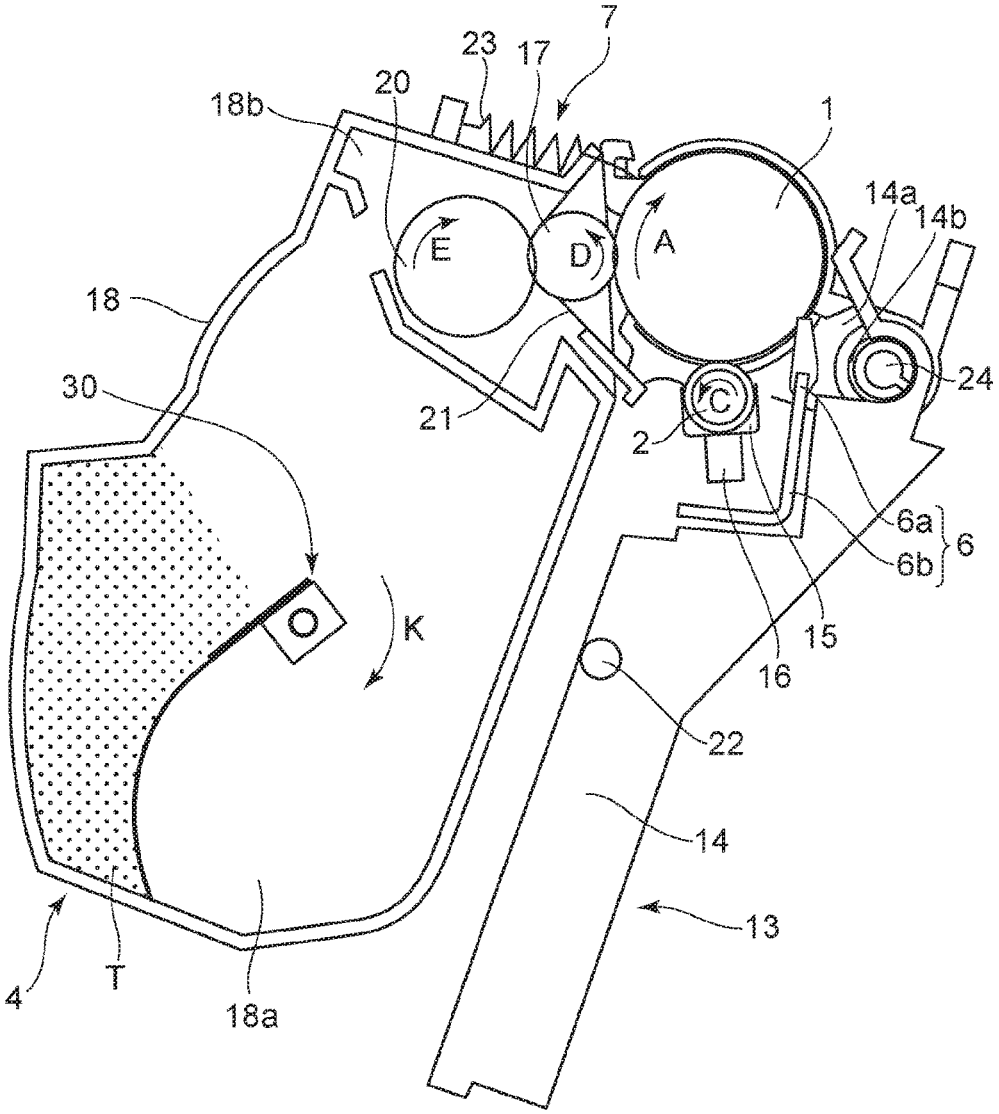
FIG. 3 is a cross-sectional conceptual diagram of the process cartridge according to the first exemplary embodiment of the present disclosure.
Figure 4:
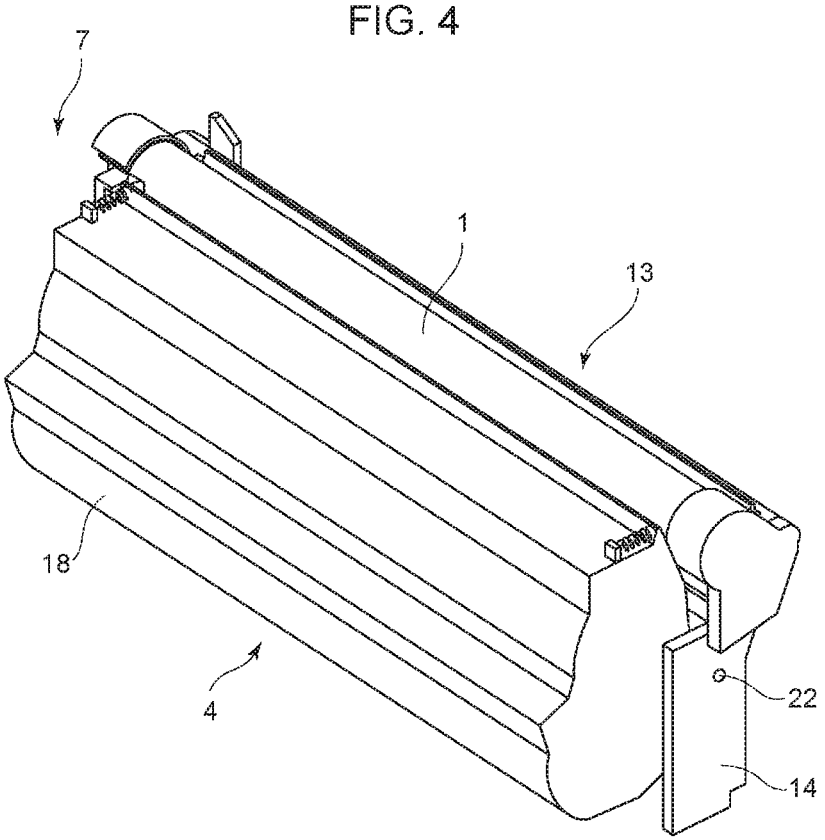
FIG. 4 is a perspective conceptual diagram of the process cartridge according to the first exemplary embodiment of the present disclosure.

Referring first to FIGS. 2 to 4, an overall configuration of an electrophotographic image forming apparatus (an image forming apparatus) in which a process cartridge according to the present exemplary embodiment is used will be described.

Note that FIG. 2 is a cross-sectional conceptual diagram of an image forming apparatus 100 in which the process cartridge according to the present exemplary embodiment is used. FIG. 3 is a cross-sectional conceptual diagram of the process cartridge according to the present exemplary embodiment. FIG. 4 is a perspective conceptual diagram of the process cartridge according to the present exemplary embodiment.

As illustrated in FIG. 2, the image forming apparatus 100 of the present exemplary embodiment includes first to fourth process cartridges 7Y, 7M, 7C, and 7K serving as a plurality of image forming units. Note that the first to fourth process cartridges (7Y, 7M, 7C, and 7K) are used to from images of various colors, namely, yellow (Y), magenta (M), cyan (C), and black (K), respectively.

In the present exemplary embodiment, the colors of the images formed by the first to fourth image forming units are different. Other than that, the configurations and operations of the first to fourth image forming units are practically the same. Accordingly, if not particularly required, hereinafter, Y, M, C, and K will be omitted and description will be given in a summative manner.

In other words, in the present exemplary embodiment, the image forming apparatus 100 includes photosensitive drums 1 (1Y, 1M, 1C, and 1K) serving as four image carrying members. The photosensitive drums 1 rotate in an arrow A direction illustrated in the figure (see FIG. 3). Charge rollers 2 and a scanner unit (an exposing device) 3 are disposed around the photosensitive drums 1.

The charge rollers 2 are charging members that uniformly charge surfaces of the photosensitive drums 1. Furthermore, the scanner unit 3 is an exposure member that projects laser beams on the photosensitive drums 1 based on image information to form electrostatic latent images on the photosensitive drums 1. Furthermore, developing apparatuses (hereinafter, developing units) 4 (4Y, 4M, 4C, and 4K) and cleaning blades 6 (6Y, 6M, 6C, and 6K) serving as the cleaning members are disposed around the photosensitive drums 1.

Furthermore, an intermediate transfer belt 5 serving as an intermediate transfer member that transfers toner images on the photosensitive drums 1 to a recording material 12 is disposed opposing the four photosensitive drums 1.

Furthermore, in the present exemplary embodiment, the developing units 4 use nonmagnetic one-component developer, that is, toner T (TY, TM, TC, and TK) as the developer. In the present exemplary embodiment, the developing units 4 perform contact development by having development rollers 17 serving as developer carrying members come in contact with the photosensitive drums 1.

Furthermore, in the present exemplary embodiment, as illustrated in FIG. 3, a photoreceptor unit 13 mainly includes the photosensitive drum 1, the charge roller 2, and the cleaning blade 6. Moreover, the photoreceptor units 13 also include removed developer accommodating portions (hereinafter, referred to as waste toner accommodating portions) 14*a* (14*a*Y, 14*a*M, 14*a*C, and 14*a*K) that accommodate residual toner (waste toner) remaining on the photosensitive drums 1.

Moreover, in the present exemplary embodiment, each developing unit 4 and the corresponding photoreceptor unit 13 are formed into a cartridge in an integrated manner to from a process cartridge 7. The process cartridges 7 are each detachably attachable to the image forming apparatus 100 through a mount member, such as a mount guide and a positioning member (not shown), provided in the image forming apparatus 100.

In the present exemplary embodiment, the process cartridges 7 of various colors all have the same shape (see FIG. 4). Furthermore, toner T (TY, TM, TC, and TK) of various colors, namely, yellow (TY), magenta (TM), cyan (TC), and black (TK), are accommodated in the process cartridges 7 of various colors.

Furthermore, the intermediate transfer belt 5 abuts against all of the photosensitive drums 1 and rotates in an arrow B direction illustrated in the drawing. The intermediate transfer belt 5 is stretched across a plurality of supporting members (a drive roller 51, an opposing roller for secondary-transfer 52, and a driven roller 53).

Four primary transfer rollers 8 (8Y, 8M, 8C, and 8K) serving as primary transfer members are arranged side by side on the inner peripheral surface side of the intermediate transfer belt 5 so as to oppose the photosensitive drums 1. Furthermore, a secondary transfer roller 9 serving as a secondary transfer member is disposed on the outer peripheral surface side of the intermediate transfer belt 5 so as to oppose the opposing roller for secondary-transfer 52.

Image Forming Process

During an image-forming period, the surfaces of the photosensitive drums 1 are first uniformly charged by the charge rollers 2. Subsequently, scanning exposure is performed on the charged surfaces of the photosensitive drums 1 with a laser beam emitted from the scanner unit 3 according to image information, and electrostatic latent images according to the image information are formed on the photosensitive drums 1.

Subsequently, the electrostatic latent images formed on the photosensitive drums 1 are developed as toner images with the developing units 4. Note that the toner images formed on the photosensitive drums 1 are transferred (primarily transferred) onto the intermediate transfer belt 5 with the work of the primary transfer rollers 8.

Subsequently, synchronizing with the movement of the intermediate transfer belt 5, the recording material 12 is conveyed to a secondary transfer portion. Furthermore, the toner images of four colors on the intermediate transfer belt 5 are secondarily transferred onto the recording material 12 in a collective manner with the work of the secondary transfer roller 9 abutting against the intermediate transfer belt 5 with the recording material 12 interposed therebetween.

The recording material 12 to which the toner images have been transferred is conveyed to a fixing apparatus 10 serving as a fixing member. The toner images are fixed to the recording material 12 by applying heat and pressure to the recording material 12 in the fixing apparatus 10.

Note that primary-transfer remaining toner remaining on the photosensitive drums 1 after the primarily transferring step is removed by the cleaning blades 6. Furthermore, secondary-transfer remaining toner remaining on the intermediate transfer belt 5 after the secondarily transferring step is removed by an intermediate transfer belt cleaning device 11.

The removed residual toner (waste toner) is discharged into a waste toner box 80 of the image forming apparatus 100. A conveying method of the waste toner will be described later.

Process Cartridge

Referring next to FIGS. 3 and 4, the overall configuration of the process cartridges 7 mounted in the image forming apparatus 100 of the present exemplary embodiment will be described.

As illustrated in FIG. 3 or 4, the photoreceptor unit 13 includes a cleaning frame 14 that serves as a frame that supports various elements inside the photoreceptor unit 13. The photosensitive drum 1 is attached to the cleaning frame 14 through a hearing member so as to be rotatable in the arrow A direction illustrated in FIG. 3.

Furthermore, a charge roller bearing 15 is attached to the cleaning frame 14 along a line passing through the rotation center of the charge roller 2 and the rotation center of the photosensitive drum 1.

Note that the charge roller bearing 15 is attached so as to be movable in an arrow C direction illustrated in FIG. 3. The charge roller 2 is rotatably attached to the charge roller bearing 15. Furthermore, the charge roller bearing 15 is urged against the photosensitive drum 1 with a charge roller pressurizing springs 16 serving as an urging member.

Furthermore, the cleaning blade 6 is integrally formed with an elastic member 6*a* that removes the residual toner (the waste toner) remaining he surface of the photosensitive drum 1 after the primary transfer, and a supporting member 6*b* that supports the elastic member.

The waste tone that has been removed from the surface of the photosensitive drum 1 with the cleaning blade 6 falls, in the gravitational direction, into a space formed between the cleaning blade 6 and the cleaning frame 14 and is accommodated inside the waste toner accommodating portion 14*a*.

The developing unit 4 includes a developing frame 18 that supports various elements inside the developing unit 4. The development roller 17 serving as the developer carrying member that rotates in an arrow D direction (counterclockwise) and that is in contact with the photosensitive drum 1 is provided in the developing unit 4. The development roller 17 is rotatably supported by the developing frame 18 at two end portions in a longitudinal direction (a rotational axis direction) of the development roller 17 through bearings.

Furthermore, the developing unit 4 includes a developer accommodating chamber (hereinafter, toner accommodating chamber) 18*a*, and a developing chamber 18*b* in which the development roller 17 is disposed. Note that the toner accommodating chamber 18*a* of the present exemplary embodiment constitutes a "developer accommodating portion" of the present disclosure. Furthermore, the developing chamber 18*b* of the present exemplary embodiment constitutes a "developing portion" of the present disclosure.

The developing chamber 18*b* includes a feed roller 20 serving as a developer feed member that is in contact with the development roller 17 and that rotates in an arrow E-direction, and a development blade 21 serving as a developer regulating member that regulates the toner layer of the development roller 17.

Furthermore, the toner accommodating chamber 18*a* of the developing frame 18 is provided with a toner conveying member 30 that agitates the accommodated toner T and that conveys the toner to the developing chamber 18*b*.

Furthermore, the developing unit 4 is connected to the photoreceptor unit 13 so as to be pivotable about a fitting shaft 22 fixed and supported by the cleaning frame 14. Furthermore, the developing unit 4 is biased by pressurizing springs (tension springs) 23. Accordingly, during the image-forming period of the process cartridge 7, the developing unit 4 turns about the fitting shaft 22 so that the photosensitive drums 1 and the development rollers 17 abut against each other.

Toner Conveying Configuration

A toner conveying configuration of the developing units 4 of the process cartridges 7 of the present exemplary embodiment will be described in detail next with reference to FIGS. 1, and 5 to 8. Note that the "toner conveying configuration" of the present exemplary embodiment is the largest feature of the present disclosure.

Figure 1:
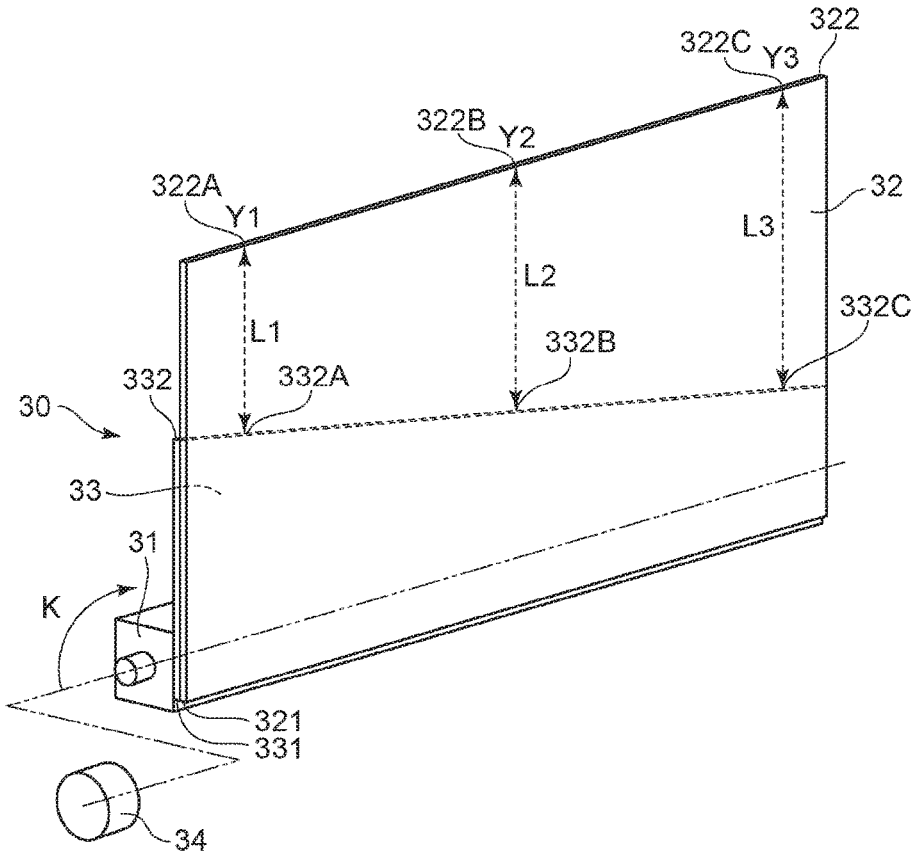
FIG. 1 is a perspective conceptual diagram of a toner conveying member in a process cartridge according to a first exemplary embodiment of the present disclosure.

Specifically, FIG. 1 is a perspective conceptual diagram of the toner conveying member in the process cartridge according to the present exemplary embodiment. Furthermore, FIG. 8 is a cross-sectional conceptual diagram illustrating a detailed conveying configuration of the process cartridge according to the present exemplary embodiment.

Figure 5:
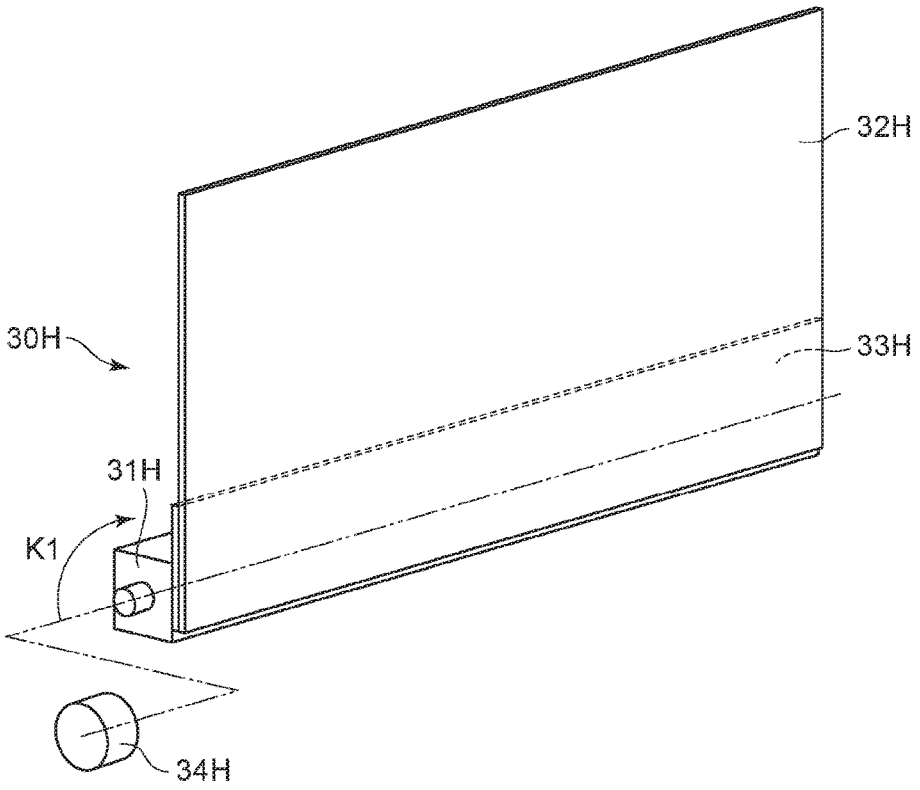
FIG. 5 is a perspective view of a toner conveying member according to a comparative example of the first exemplary embodiment of the present disclosure.
Figure 6:
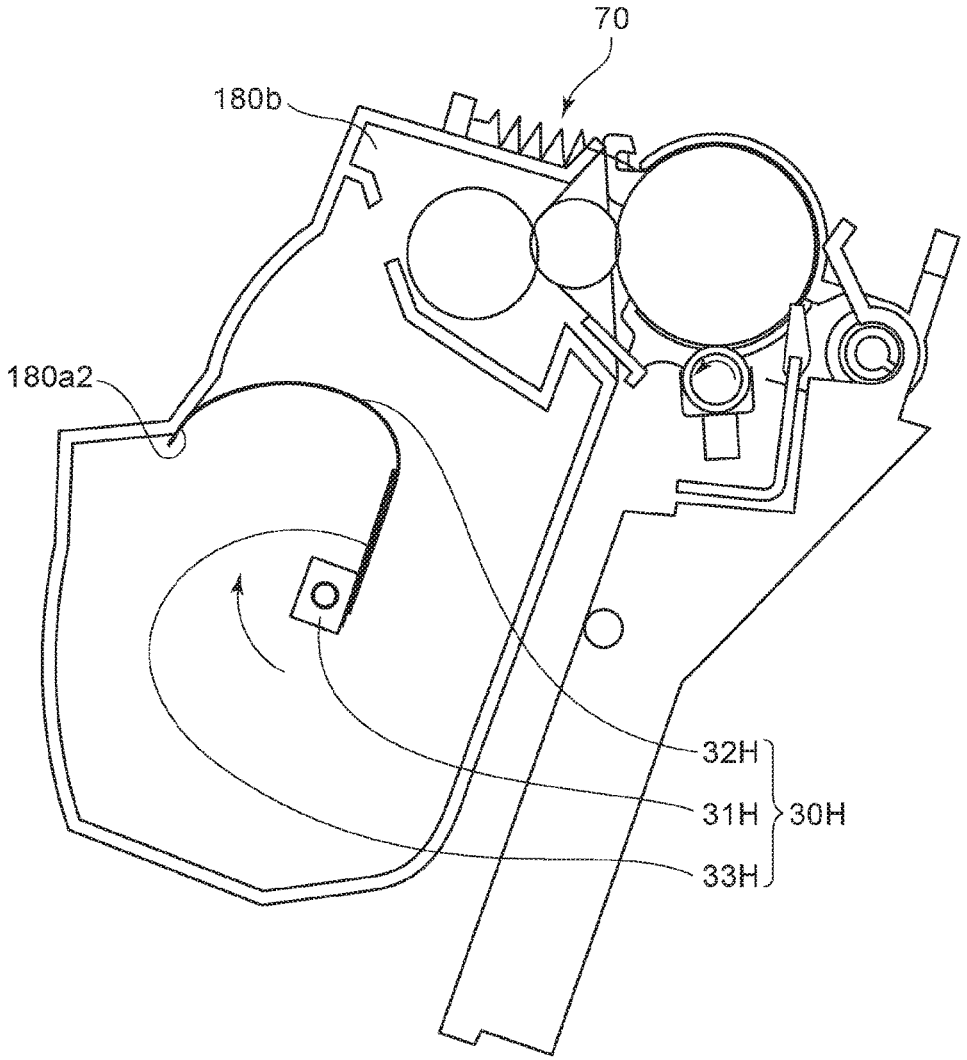
FIG. 6 is a cross-sectional view of the process cartridge according to the comparative example of the first exemplary embodiment of the present disclosure.

Meanwhile, FIG. 5 is a perspective view of a toner conveying member according to a comparative example to perform comparison with the present exemplary embodiment. Furthermore, FIG. 6 is a cross-sectional view of a process cartridge according to the comparative example to perform comparison with the present exemplary embodiment. Moreover, FIG. 7 is a diagram illustrating relationships between toner conveyance amounts and positions in the longitudinal direction according to the comparative example to compare with the present exemplary embodiment.

Figure 8:
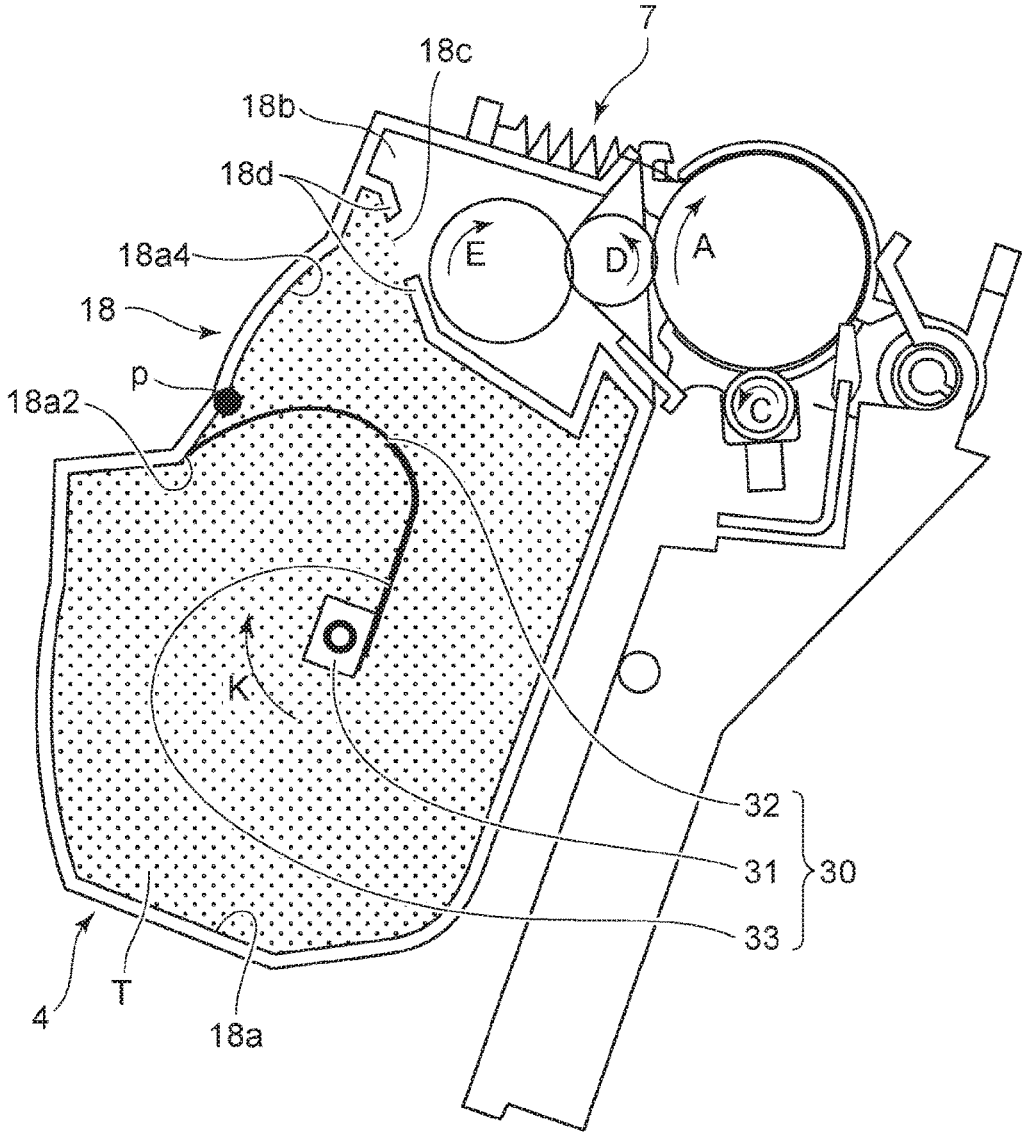
FIG. 8 is a cross-sectional conceptual diagram illustrating a detailed conveying configuration of the process cartridge according to the first exemplary embodiment of the present disclosure.

As illustrated in FIG. 8, in the present exemplary embodiment, the developing unit 4 includes the developing chamber 18*b* (the developing portion) positioned on the upper side, and the toner accommodating chamber 18*a* (the developer accommodating portion) positioned on the lower side. The development roller 17, the feed roller 20, the development blade 21, and other members are disposed in the developing chamber 18*b*. Meanwhile, the toner accommodating chamber 18*a* contains the toner fed to the developing chamber I Sb and is provided with the toner conveying member 30 that conveys the toner to the developing chamber 18*b*.

Furthermore, since the toner accommodating chamber 18*a* is disposed vertically below the developing chamber 18*b*, the toner needs to be conveyed from the toner accommodating chamber 18*a* to the developing chamber 18*b* while countering the gravitational force.

Side walls 18*d* that form an opening 18*c* through which the toner passes is provided between the developing chamber 18*b* and the toner accommodating chamber 18*a*. Note that the opening 18*c* is provided on the upper side of the toner accommodating chamber 18*a*. The toner accommodating chamber 18*a* and the developing chamber 18*b* are in communication with each other with the opening 18*c* in the above manner.

Furthermore, the toner conveying member 30 provided inside the toner accommodating chamber 18*a* includes a conveyance shaft 31, an elastic first sheet member 32, and a second sheet member 33 described later. Note that the first sheet member 32 and the second sheet member 33 are supported by the conveyance shaft 31 so as to be rotatable in an arrow K direction.

Two end portions of the toner conveying member 30 in the longitudinal direction (the rotational axis direction) are rotatably supported by the developing frame 18 that forms the toner accommodating chamber 18*a*. One end of the toner conveying member 30 is rotationally driven in the arrow K direction with a drive transmission member 34.

In the toner accommodating chamber 18*a*, a guide portion 18*a*2 serving as a deformation portion that bends and deforms the sheet member by having the first sheet member 32 abut thereagainst is provided below the opening 18*c*.

Furthermore, the first sheet member 32 abuts against the guide portion 18*a*2 an abutment portion) in association with the rotation of the rotating shaft. With the above, the first sheet member 32 is bent by the guide portion 18*a*2. As a result, the first sheet member 32 countering the elastic three of the first sheet member 32 elastically deforms.

Furthermore, by rotating the first sheet member 32 so that the first sheet member 32 is in contact with the guide portion

18*a*2, the toner can be conveyed while being carried on the surface on the downstream side in the rotation direction. Note that in the present exemplary embodiment, the guide portion 18*a*2 is constituted by an inner wall of the toner accommodating chamber 18*a* illustrated in FIG. 6 and extends to a point p where the first sheet member 32 becomes separated therefrom.

Furthermore, a restoring portion 18*a*4 is provided in the toner accommodating chamber 18*a* in a portion that is downstream of the guide portion 18*a*2 and that is upstream of the opening 18*c* in the rotation direction of the first sheet member 32. Not that the restoring portion 18*a*4 is a portion where the contact between the first sheet member 32 and the inner wall of the toner accommodating chamber 18*a* are released.

Accordingly, in association with the rotation of the first sheet member 32, abutment between the first sheet member 32 and the inner wall of the toner accommodating chamber 18*a* is released after a distal end of a free end side (a side of the inner wall of the toner accommodating chamber 18*a*) of the first sheet member 32 passes the guide portion 18*a*2. The first sheet member 32 is released from the state in which the first sheet member 32 is deformed by the guide portion 18*a*2, and by its own elastic restoring force, is restored to its natural state (original shape). With the above shape change of the first sheet member 32 in a restoring direction, the toner that is carried and conveyed on the first sheet member 32 is further soared up towards the opening 18*c* while countering the gravitational force.

(Conventional Toner Conveying Configuration (Comparative Example))

Referring first to FIGS. 5 to 7 that illustrate the comparative example, a configuration of a conventional toner conveying member 30H and a process cartridge 70 gill be described hereinafter.

Note that FIG. 5 is a perspective view of the toner conveying member according to a comparative example of the first exemplary embodiment of the present disclosure. Furthermore, FIG. 6 is a cross-sectional view of the process cartridge according to the comparative example of the first exemplary embodiment of the present disclosure. Moreover, FIG. 7 is a diagram illustrating relationships between toner conveyance amounts and positions in the longitudinal direction according to the comparative example of the first exemplary embodiment of the present disclosure.

in the comparative example illustrated in FIG. 5, the second sheet member 33H is fixed to a surface of a conveyance shaft 31H that is a surface that is the same as the surface on which a first sheet member 32H is fixed. Furthermore, the second sheet member 33H is disposed upstream of the first sheet member 32H in a rotation direction K1. Moreover, a distance from a fixed end to a distal end (a free end) of the second sheet member 33H is shorter than that of the first sheet member 32H.

In the configuration of the toner conveying member 30H of the comparative example illustrated in FIG. 5, it can be understood that the rigidity of the overall sheet of the toner conveying member 30H becomes higher due to the reinforcing effect of the second sheet member 33H then compared to a case in which the first sheet member 32H alone is provided without the second sheet member 33H.

In other words, as in the comparative example illustrated in FIG. 6, the first sheet member 32H, while carrying the toner, becomes (elastically) deformed by abutting against a guide portion 180*a*2 of a toner accommodating chamber. Furthermore, the toner is conveyed upwards with the elastic restoring force generated when the elastically deformed first sheet member 32H becomes separated from the guide portion 180*a*2.

There is a problem in the conventional configuration such as the comparative example illustrated in FIG. 5 in that the toner conveyance amount to the developing chamber positioned on the upper side is non-uniform in a longitudinal direction of a conveyance shaft 31H.

In other words, as illustrated in the comparative example illustrated in FIG. 5, when the conveyance shaft 31H is an elastic body such as a resin and when driving force from a drive transmission member 34H is received by one end of the conveyance shaft 31H, the conveyance shaft 31H becomes twisted and deformed due to resistance of the toner inside the toner accommodating chamber. The twisting and deformation amount of the conveyance shaft 31H becomes relatively smaller on one side where the drive transmission member exists (hereinafter, a drive side) and becomes relatively larger on the other side where the drive transmission member does not exist (hereinafter, a non-drive side).

Accordingly, the toner bearing amount carried on the abutment portion between the first sheet member 32H and the guide portion 180*a*2 becomes non-uniform in the longitudinal direction (a conveyance shaft direction) due to the twisting and deformation of the conveyance shaft 31H. Specifically, the toner bearing amount becomes larger on the non-drive side than on the drive side.

The reason for the above is that since the amount of twisting and deformation in the conveyance shaft 31H is smaller on the drive side that is closer to the drive transmission member 34H, the abutment portion between the distal end of the first sheet member 32H and the guide portion 180*a*2 is further positioned on the downstream side with respect to the non-drive side in the rotation direction K1. Furthermore, since a difference in the abutted state (abutment portion position) between the first sheet member 32H and the guide portion 180*a*2 is created in the longitudinal direction, a tendency of the toner moving from the drive side towards the non-drive side is seen more easily. As a result, the toner bearing amount on the drive side becomes smaller and, conversely, the toner bearing amount on the non-drive side becomes larger.

When the abutted state (elastically deformed state) between the first sheet member 32H and the guide portion 180*a*2 are released (elasticity restored) as illustrated in FIG. 6, then, as illustrated in FIG. 7, the amount of toner conveyed to a developing chamber 180*b* is small on the drive side and is large on the non-drive side. In other words, the toner conveyance amount becomes non-uniform in the longitudinal direction. Note that FIG. 7 illustrates relationships between the toner bearing amount described above, the toner conveying capacity, and the toner conveyance amount.

Feature of Toner Conveying Configuration of Present Exemplary Embodiment

In light of the problem of the "Conventional toner conveying configuration (comparative example))" described above, the conveying configuration, which is the largest feature of the process cartridge of the present exemplary embodiment, will be described next with reference to FIGS. 1, 8, and 9.

Note that FIG. 1 is a perspective conceptual diagram of the toner conveying member in the process cartridge according to the first exemplary embodiment of the present disclosure. Furthermore, FIG. 8 is a cross-sectional conceptual diagram illustrating a detailed conveying configuration of the process cartridge according to the first exemplary embodiment of the present disclosure. Moreover, FIG. 9 is a diagram illustrating relationships between the toner conveyance amounts and the positions in the longitudinal direction according to the first exemplary embodiment of the present disclosure.

As illustrated in FIG. 1, in the present exemplary embodiment, regarding a distance between a fixed end 331 and a distal end (free end) 332 of the second sheet member 33, a distance on the drive side (332A) (a side that is closer to the drive transmission member 34 in the longitudinal direction) is longer than that on the non-drive side(332B).

In the positions in the sheet in the longitudinal direction, a position on the drive side is referred to as (Y1), that at the middle is referred to as (Y2), and that on the non-drive side is referred to as (Y3). In the positions Y1, Y2, and Y3, when a distance between a distal end of the first sheet member 32 and a distal end of the second sheet member 33 is referred to as L1, L2, and L3, the distance L1 is shorter than distance L3 (L1<L2<L3).

In more detail, in the present exemplary embodiment, the developing unit 4 (the developing apparatus) includes the developer accommodating portion (the toner accommodating chamber 18*a*) that accommodates the developer, and the conveyance shaft (the toner conveyance shaft 31). Note that the conveyance shaft (31) is provided in the developer accommodating portion, is configured so as to be capable of conveying the developer accommodated in the developer accommodating portion, and can be rotated in a predetermined rotation direction K.

Furthermore, the developing unit 4 (the developing apparatus) includes a first conveying member (the first sheet member 32) and a second conveying member (the second sheet member 33) provided in the developer accommodating portion. Furthermore, the developing unit 4 (the developing apparatus) includes the drive transmission member 34 that is connected to one end of the conveyance shaft in the axial direction and that rotates the conveyance shaft by receiving driving force from outside (main body of the image forming apparatus).

Note that a first end of the first conveying member is attached to the conveyance shaft as a fixed end 321, and a second end is a free end 322. Furthermore, a first end of the second conveying member is attached to the conveyance shaft as the fixed end 331, and a second end is a free end 332. Furthermore, regarding lengths between the fixed end and the free end, the second conveying member has a length that is shorter than that of the first conveying member.

Moreover, in the developing unit 4 (developing apparatus) of the present exemplary embodiment, the second conveying member is disposed upstream of the first conveying member in the rotation direction K of the conveyance shaft so that the fixed end 331 of the second conveying member and the fixed end 321 of the first conveying member overlap with each other. Furthermore, in the first, second, and third positions that become more separated from the drive transmission member in the axial direction of the conveyance shaft in that order, distances (L1, L2, and L3) between the free ends (322A, 322B, and 322C) of the first conveying member and the free ends (332A, 332B, and 332C) of the second conveying member becomes larger in that order.

According to the configuration of the process cartridge of the present exemplary embodiment, the elastic restoring force of the first sheet member 32 on the drive side is larger than that on the non-drive side, and the amount of toner conveyed to the developing chamber 18*b* can be improved also on the drive side where the toner bearing amount is small.

In other words, as illustrated in FIG. 9, in the present exemplary embodiment, the toner conveyance amount on the drive side and that on the non-drive side in the developing chamber 18*b* becomes similar more easily; accordingly, the toner can be fed to the development roller in a further uniform manner in the longitudinal direction. Note that FIG. 9 illustrates the relationships between the toner conveyance amounts and the positions in the longitudinal direction according to the present exemplary embodiment.

As described above, in the present exemplary embodiment, the distance between the free end of the first conveying member and the free end of the second conveying member may be configured to continuously change in the axial direction of the conveyance shaft. With the above, the toner can be conveyed in a more uniform manner in the longitudinal direction.

The distance between the free end of the first conveying member and the free end of the second conveying member may be configured to change across the entire area in the axial direction of the conveyance shaft. With the above, the toner can be conveyed in a uniform manner across the entire area in the longitudinal direction.

Note that in the present exemplary embodiment, the first conveying member and the second conveying member are each desirably an elastic sheet-shaped member. With the above, the toner can be conveyed upwards in the gravitational direction in a reliable manner with the elastic restoring force created by elastic deformation.

Furthermore, the second conveying member is desirably thicker than the first conveying member. With the above, the first conveying member can be reinforced in a more effective manner, and the toner can be conveyed efficiently.

Furthermore, the second conveying member desirably has a bend elastic constant that is higher than that of the first conveying member. With the above, the first conveying member can be reinforced in a more effective manner, and the toner can be conveyed efficiently.

Furthermore, in the present exemplary embodiment, the developing unit (developing apparatus) can be configured to be detachably attachable to the main body of the image forming apparatus that forms an image.

Furthermore, the process cartridge of the present exemplary embodiment may be configured to be detachably attachable to the main body of the image forming apparatus that forms an image, and may include the developing unit (the developing apparatus) and the image carrying member that carries an electrostatic latent image. Note that the electrostatic latent image carried on the image carrying member is developed by the developing apparatus.

Others

In the present exemplary embodiment, the first sheet member 32 and the second sheet member 33 are installed so as to overlap each other (in other words, in contact with each other in a thickness direction); however, the first sheet member 32 and the second sheet member 33 may be disposed with a slight gap in between (in other words, disposed so as to not come in contact with each other in the thickness direction). The above is because a similar effect can be obtained if the first sheet member 32 being released from the guide portion 18*a*2 comes in contact with the second sheet member 33.

Furthermore, the first sheet member 32 and the second sheet member 33 can be suitably fabricated using, as the material, a flexible resin sheet such as, for example, polyester film, polyphenylenesulfide film, or polycarbonate film. Furthermore, the sheets are preferably 50 μm to 250 μm in thickness.

Furthermore, while an exemplary process cartridge has been described in detail in the present exemplary embodiment, the toner conveying configuration is similar in the case of the developing apparatus (developing unit) as well.

Second Exemplary Embodiment

A second exemplary embodiment of the present disclosure basically has a configuration similar to that of the first exemplary embodiment. Points that are different will be described with reference to FIG. 10. Note that FIG. 10 is a perspective conceptual diagram of the toner conveying member according to the second exemplary embodiment of the present disclosure.

In the first exemplary embodiment the distance (L1, L2, and L3) between the distal end of the first sheet member 32 and the distal end of the second sheet member 33 is continuously changed.

Figure 10:
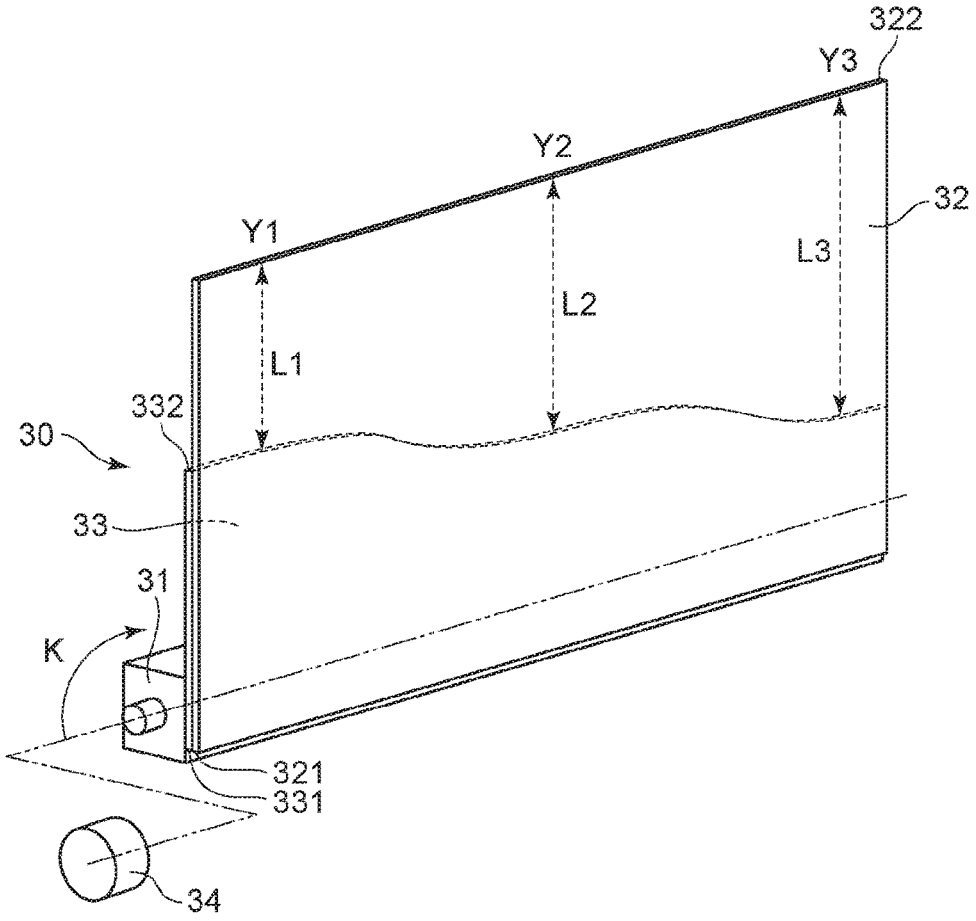
FIG. 10 is a perspective conceptual diagram of a toner conveying member according to a second exemplary embodiment of the present disclosure.

In the second exemplary embodiment, as illustrated in FIG. 10, the distance (L1, L2, and L3) between the distal end of the first sheet member 32 and the distal end of the second sheet member 33 is changed in a discontinuous manner from L1 to L3.

In other words, as the position changes from position Y1 that is close to the drive transmitted position towards position Y3 that is distanced away from the drive transmitted position, distance L1, L2, and L3 may be appropriately configured, except for becoming smaller in this order and except for changing continuously.

Third Exemplary Embodiment

A third exemplary embodiment of the present disclosure basically has a configuration similar to that of the first exemplary embodiment. Points that are different will be described with reference to FIG. 11. Note that FIG. 11 is a perspective conceptual diagram of the toner conveying member according to the third exemplary embodiment of the present disclosure.

Figure 11:
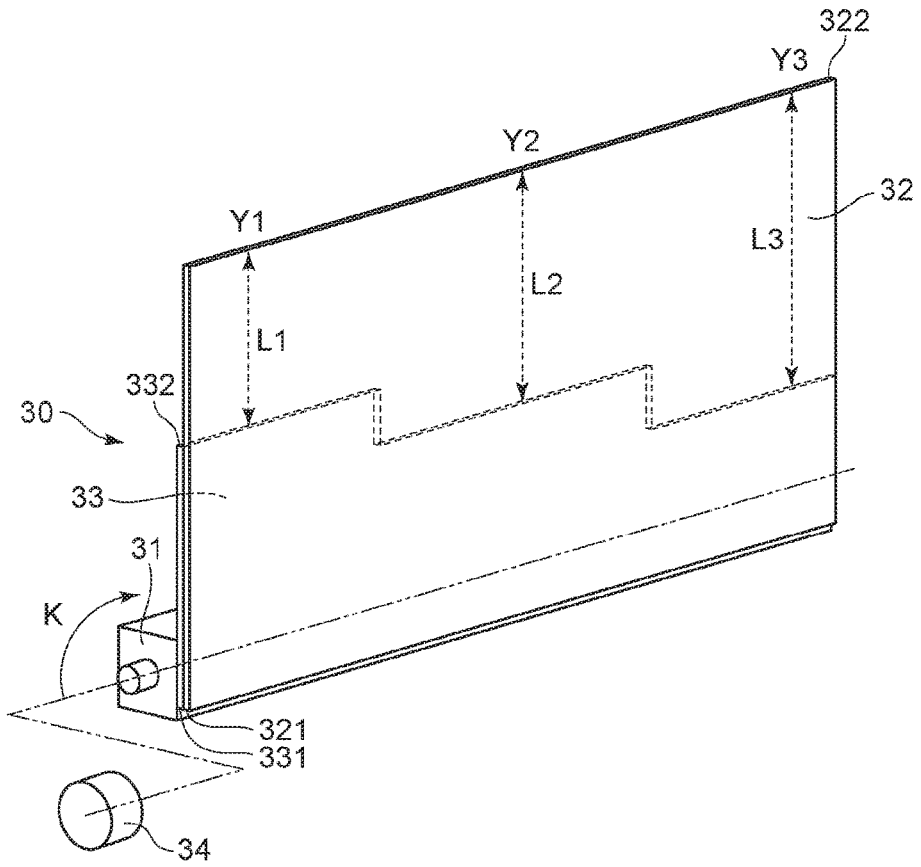
FIG. 11 is a perspective conceptual diagram of a toner conveying member according to a third exemplary embodiment of the present disclosure.

In the present exemplary embodiment, as illustrated in FIG. 11, the distance (L1, L2, and L3) between the distal end of the first sheet member 32 and the distal end of the second sheet member 33 is changed in a stepwise manner from L1 to L3.

In other words, the distance between the free end of the first conveying member and the free end of the second conveying member may be configured to change in a stepwise manner in the axial direction of the conveyance shaft. Note that in the present exemplary embodiment, while the stepwise manner having three steps, namely, L1 to L3, is described as an example, the number of steps may be four or more.

Fourth Exemplary Embodiment

A fourth exemplary embodiment of the present disclosure basically has a configuration similar to that of the first exemplary embodiment. Points that are differ will be described with reference to FIG. 12. Note that FIG. 12 is a perspective conceptual diagram of the toner conveying member according to the fourth exemplary embodiment of the present disclosure.

Figure 12:
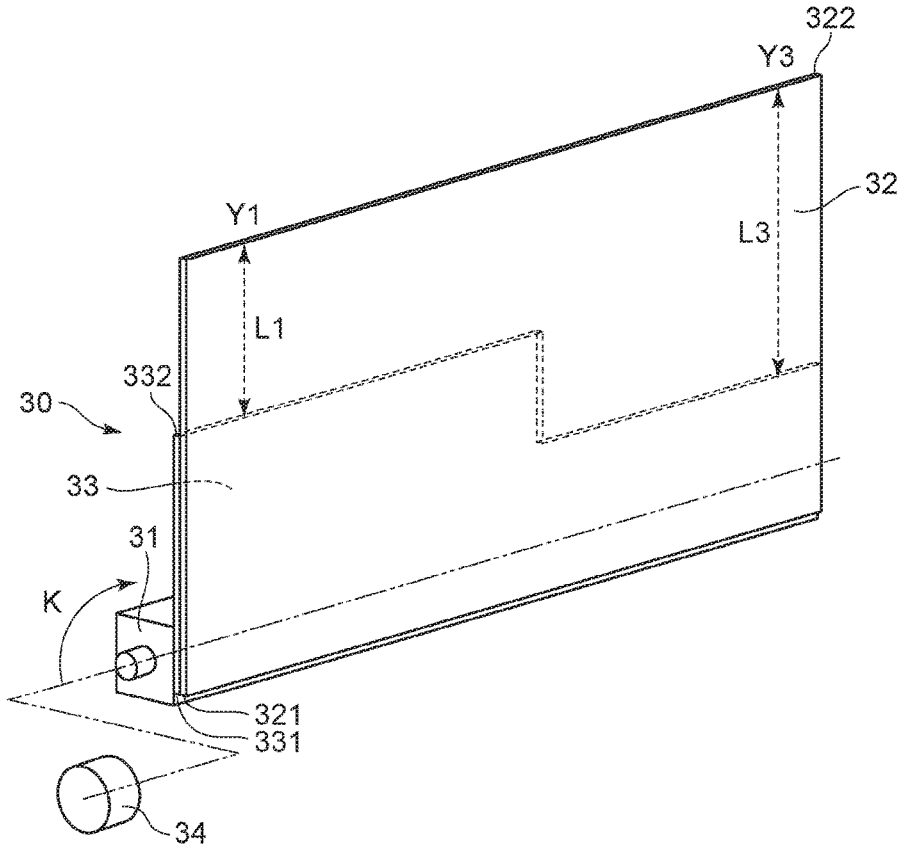
FIG. 12 is a perspective conceptual diagram of a toner conveying member according to a fourth exemplary embodiment of the present disclosure.

In the present exemplary embodiment, as illustrated in FIG. 12, the distance between the distal end of the first sheet member 32 and the distal end of the second sheet member 33 is changed in two steps so that L1<L3 is satisfied.

In other words, in the developing unit 4, in the position (Y1) that is closest to the drive transmission member 34 and the position (Y3) that is farthest away from the drive transmission member 34 in the axial direction of the toner conveyance shaft 31, it is only sufficient that regarding the distances between the free ends of the first and second conveying members, the distance at the position that is the farthest away is larger than the distance at the position that is the closest (L1<L3).

The present disclosure is capable of making the toner amount conveyed from the developer accommodating chamber to the developing chamber further uniform in the longitudinal direction.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-191932 filed Sep. 29, 2017, which is hereby incorporated by reference herein in its entirety.

What is claimed is:

1. A developing apparatus comprising:

a developing portion that accommodates a developer carrying member that carries developer;

a developer accommodating portion disposed below the developing portion, the developer accommodating portion accommodating the developer;

a conveyance shaft provided in the developer accommodating portion, the conveyance shaft being capable of conveying the developer accommodated in the developer accommodating portion and being rotatable in a predetermined rotation direction;

a drive transmission member which is provided on the developer accommodating portion and which is connected to one end of the conveyance shaft in an axial direction of the conveyance shaft, the drive transmission member rotating the conveyance shaft by receiving driving force from outside;

a first conveying member, having a first end thereof being a fixed end attached to the conveyance shaft and a second end thereof being a free end; and a second conveying member, having a first end thereof being a fixed end attached to the conveyance shaft, and a second end thereof being a free end, and a length between the fixed end and the free end of the second conveying member being shorter than that of the first conveying member, wherein the second conveying member is disposed upstream of the first conveying member in a rotation direction of the conveyance shaft in a state in which the fixed end of the second conveying member and the fixed end of the first conveying member overlap each other, and wherein in a first position, a second position, and a third position that sequentially distance away from the drive transmission member in the axial direction of the conveyance shaft, a distance between the free end of the first conveying member and the free end of the second conveying member sequentially becomes larger as well.

2. The developing apparatus according to claim 1, wherein the distance between the free end of the first conveying member and the free end of the second conveying member continuously changes in the axial direction of the conveyance shaft.

3. The developing apparatus according to claim 2, wherein the distance between the free end of the first conveying member and the free end of the second conveying member changes in an entire area in the axial direction of the conveyance shaft.

4. The developing apparatus according to claim 1, wherein the distance between the free end of the first conveying member and the free end of the second conveying member changes in a stepwise manner in the axial direction of the conveyance shaft.

5. The developing apparatus according to claim 1, wherein the first conveying member and the second conveying member are each an elastic sheet-shaped member.

6. The developing apparatus according to claim 5, wherein the second conveying member is thicker than the first conveying member.

7. The developing apparatus according to claim 5, wherein the developer accommodated in the developer accommodating portion is fed to the developing portion by elastic restoring force generated when the first and second conveying members that have been elastically deformed are restored to original states.

8. The developing apparatus according to claim 1, wherein the second conveying member has a bend elastic constant that is larger than that of the first conveying member.

9. The developing apparatus according to claim 1, wherein the developing apparatuses is detachably attachable to a main body of an image forming apparatus that forms an image.

10. A developing apparatus comprising:

a developing portion that accommodates a developer carrying member that carries developer;

a developer accommodating portion disposed below the developing portion, the developer accommodating portion accommodating the developer;

a conveyance shaft provided in the developer accommodating portion, the conveyance shaft being capable of conveying the developer accommodated in the developer accommodating portion and being rotatable in a predetermined rotation direction;

a drive transmission member which is provided on the developer accommodating portion and which is connected to one end of the conveyance shaft in an axial direction of the conveyance shaft, the drive transmission member rotating the conveyance shaft by receiving driving force from outside;

a first conveying member, having a first end thereof being a fixed end attached to the conveyance shaft and a second end thereof being a free end; and a second conveying member, having a first end thereof being a fixed end attached to the conveyance shaft, and a second end thereof being a free end, and a length between the fixed end and the free end of the second conveyance member being shorter than that of the first conveying member, wherein the second conveying member is disposed upstream of the first conveying member in a rotation direction of the conveyance shaft in a state in which the fixed end of the second conveying member and the fixed end of the first conveying member overlap each other, and wherein in a position closest to the drive transmission member and a position farthest away from the drive transmission member in the axial direction of the conveyance shaft, a distance between the free end of the first conveying member and the free end of the second conveying member is larger at the position farthest away than at the position closest.

11. The developing apparatus according to claim 10, wherein the distance between the free end of the first conveying member and the free end of the second conveying member changes in a stepwise manner in the axial direction of the conveyance shaft.

12. The developing apparatus according to claim 10, wherein the first conveying member and the second conveying member are each an elastic sheet-shaped member.

13. The developing apparatus according to claim 12, wherein the second conveying member is thicker than the first conveying member.

14. The developing apparatus according to claim 12, wherein the developer accommodated in the developer accommodating portion is fed to the developing portion by elastic restoring three generated when the first and second conveying members that have been elastically deformed are restored to original states.

15. The developing apparatus according to claim 10, wherein the second conveying member has a bend elastic constant that is larger than that of the first conveying member.

16. The developing apparatus according to claim 10, wherein the developing apparatuses is detachably attachable to a main body of an image forming apparatus that forms an image.

17. A process cartridge detachably attachable to a main body of an image forming apparatus that forms an image, the process cartridge comprising:

a developing apparatus including:

a developing portion that accommodates a developer carrying member that carries developer;

a developer accommodating portion disposed below the developing portion, the developer accommodating portion accommodating the developer;

a conveyance shaft provided in the developer accommodating portion, the conveyance shaft being capable of conveying the developer accommodated in the developer accommodating portion and being rotatable in a predetermined rotation direction;

a drive transmission member which is provided on the developer accommodating portion and which is connected to one end of the conveyance shaft in an axial direction of the conveyance shaft, the drive transmission member rotating the conveyance shaft by receiving driving force from outside;

a first conveying member, having a first end thereof being a fixed end attached to the conveyance shaft and a second end thereof being a free end; and a second conveying member, having a first end thereof being a fixed end attached to the conveyance shaft, and a second end thereof being a free end, and a length between the fixed end and the free end of the second conveying member being shorter than that of the first conveying member, wherein the second conveying member is disposed upstream of the first conveying member in a rotation direction of the conveyance shaft in a state in which the fixed end of the second conveying member and the fixed end of the first conveying member overlap each other, and wherein in a first position, a second position, and a third position that sequentially distance away from the drive transmission member in the axial direction of the conveyance shaft, a distance between the free end of the first conveying member and the free end of the second conveying member sequentially becomes larger as well; and an image carrying member that carries an electrostatic latent image, wherein the electrostatic latent image carried on the image carrying member is developed with the developing apparatus.

18. A process cartridge detachably attachable to a main body of an image forming apparatus that forms an image, the process cartridge comprising:

a developing apparatus including:

a developing portion that accommodates a developer carrying member that carries developer;

a developer accommodating portion disposed below the developing portion, the developer accommodating portion accommodating the developer;

a conveyance shaft provided in the developer accommodating portion, the conveyance shaft being capable of conveying the developer accommodated in the developer accommodating portion and being rotatable in a predetermined rotation direction;

a drive transmission member which is provided on the developer accommodating portion and which is connected to one end of the conveyance shaft in an axial direction of the conveyance shaft, the drive transmission member rotating the conveyance shaft by receiving driving force from outside;

a first conveying member, having a first end thereof being a fixed end attached to the conveyance shaft and a second end thereof being a free end; and a second conveying member, having a first end thereof being a fixed end attached to the conveyance shaft, and a second end thereof being a free end, and a length between the fixed end and the free end of the second conveyance member being shorter than that of the first conveying member, wherein the second conveying member is disposed upstream of he first conveying member in a rotation direction of the conveyance shaft in a state in which the fixed end of the second conveying member and the fixed end of the first conveying member overlap each other, and wherein in a position closest to the drive transmission member and a position farthest away from the drive transmission member in the axial direction of the conveyance shaft, a distance between the free end of the first conveying member and the free end of the second conveying member is larger at the position farthest away than at the position closest; and an image carrying member that carries an electrostatic latent image, wherein the electrostatic latent image carried on the image carrying member is developed with the developing apparatus.

* * * * *